United States Patent [19]

Leach, Sr.

[11] 3,967,467

[45] July 6, 1976

[54] MANUAL KNITTING FRAME

[76] Inventor: Clifford Leach, Sr., 1947 Woodglen Lane No. 1, Vacaville, Calif. 95688

[22] Filed: Mar. 3, 1975

[21] Appl. No.: 554,930

[52] U.S. Cl. ..... 66/4
[51] Int. Cl.[2] ..... D04B 3/00
[58] Field of Search ..... 66/1, 1 A, 3, 4

[56] References Cited

UNITED STATES PATENTS

| | | | |
|---|---|---|---|
| 2,072,668 | 3/1937 | Eltgroth | 66/4 |
| 2,112,768 | 3/1938 | Fox | 66/1 A |
| 2,237,733 | 4/1941 | Grimm et al. | 66/4 |
| 2,270,619 | 1/1942 | Bowxer | 61/4 |

FOREIGN PATENTS OR APPLICATIONS

| | | | |
|---|---|---|---|
| 945,565 | 11/1948 | France | 66/4 |
| 408,380 | 12/1944 | Italy | 66/4 |
| 330,087 | 5/1958 | Switzerland | 66/4 |
| 23,509 | 11/1894 | United Kingdom | 66/4 |

*Primary Examiner*—Ronald Feldbaum
*Attorney, Agent, or Firm*—Robert Keith Sharp

[57] ABSTRACT

A manual knitting frame comprising two parallel elongated bars which are held apart to leave a relatively narrow slot between them. Each bar carries a row of uniformly spaced relatively short upright pins over which the yarn is looped during the knitting. To vary and standardize the length of the stitches, means are provided for spacing the bars apart by any one of several fixed but selectable distances. Removable pattern strips located beside the rows of pins are used to guide the knitting of various articles.

3 Claims, 11 Drawing Figures

MANUAL KNITTING FRAME

INTRODUCTION

This invention relates to a manual knitting frame having refinements which make it extremely versatile. The object of the invention is to provide a device which will permit even an inexperienced person, supplied with the proper instructions, to reproducibly form a wide variety of knitted articles.

BACKGROUND

Manual knitting frames are said to have been used in past centuries in various countries. The brief descriptions which I have seen give no indication of means for varying stitch length nor of a provision for patterns for guidance of the user. The only actual frame of which I have personal knowledge is a crude device, used in certain rural sections of the United States, formed of two boards into which nails are driven. A circular frame is briefly described in the literature, but appears to be limited to the knitting of tubular material and to have no provision for variation in stitch length.

A number of U.S. and foreign patents disclose knitting frames formed of two parallel bars with means for adjusting the space between them. However, the adjusting means shown are either inconvenient or are not suitable for accurately spacing the bars predetermined distances apart.

SUMMARY OF INVENTION

This invention relates to a manual knitting frame comprising two parallel elongated bars which are held spaced apart so as to leave a relatively narrow gap between them. Each bar carries a row of uniformly spaced upright pins, over which the yarn is looped during the knitting.

The length of the stitch is governed by the distance between the rows of pins. In order to control this distance I provide means for holding the bars apart by any one of several fixed but selectable distances. In one modification this is accomplished by eccentric stitch selectors mounted in one bar which engage detents in the other bar. In the other modification, dowel pins are utilized which fit in sockets in the respective bars.

As a basis for use of the knitting frame in cooperation with charts and instructions, I provide the frame with removable pattern strips adjacent to the pins. These strips carry legends which indicate the starting and finishing points for applying the yarn for various rows of stitches, and the two extremities of those rows, as will be explained later.

DETAILED DESCRIPTION

Figure 1:
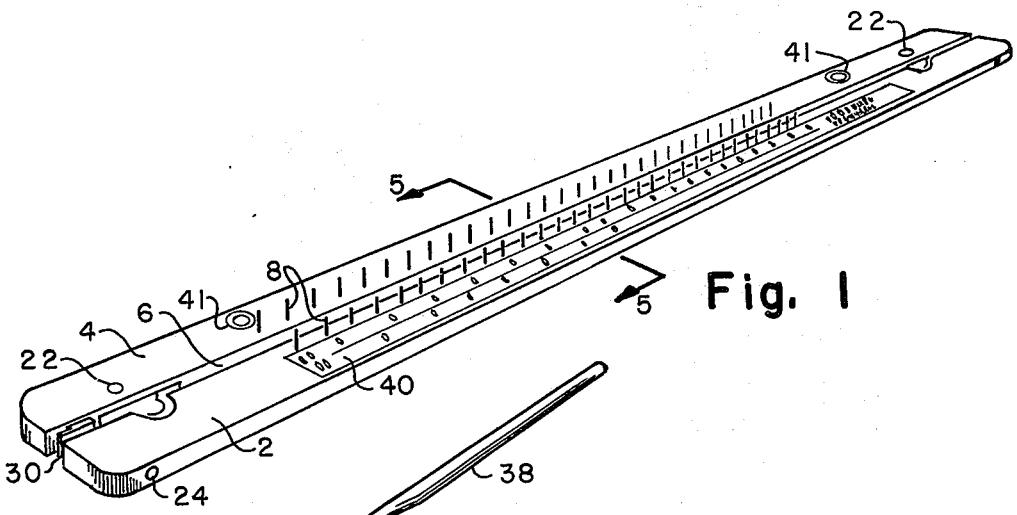
FIG. 1 is a perspective view of the knitting frame, somewhat diagramatic and with some parts removed.
Figure 2:
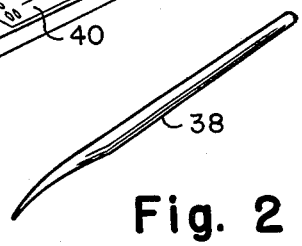
FIG. 2 is a perspective view of a pick used with the frame.
Figure 3B:
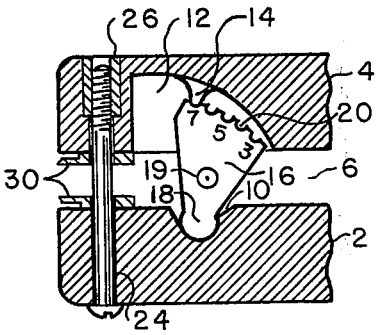
FIGS. 3*a* and 3*b* are, respectively, a partial plan view and a partial section showing one form of variable spacing means.
Figure 3A:
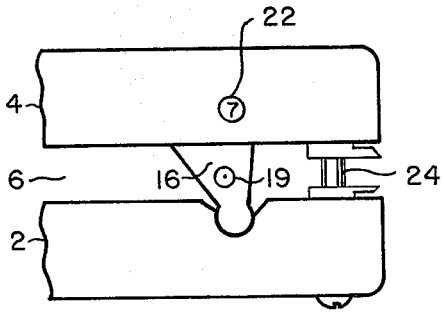

Referring to the drawing, FIGS. 1, 3*a* and 3*b*, my knitting frame includes two straight, parallel, elongated bars or frame members 2,4, spaced apart to leave a slot 6 between them. Each frame member carries a row of upright pins, 8. It will be noted that the upper surface of members 2 and 4 define a plane and that the pins 8 are perpendicular to that plane. Typically, members 2 and 4 may each be about one inch wide and fourteen to 24 inches long, with pins 8 about ⅜ in. high, spaced about ⅜ in. apart and about ¼ in. from the edges of slot 6. These dimensions are by no means compulsory and the frame may be made larger or smaller as desired, to utilize yarn of different weight and to make articles of different types.

In general, the pins are spaced apart in the rows by a distance which is of the same order of magnitude as their height. Th distance between the rows is adjustable, as will be explained later, but lies in the approximate range of twice the height of the pins to six times that height. Thus, when the pins have a height of ⅜ in., and the other dimensions are as described above, the distance between the rows of pins may range from about ¾ in. to 2¼ in. The slot 6 must be of sufficient breadth to permit the knitted fabric to emerge through it. In my typical example the minimum is about ¼ in.

Figure 5A:
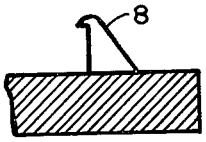
FIG. 5*a* is a partial section on the line 5—5 showing one form of pin.
Figure 5B:
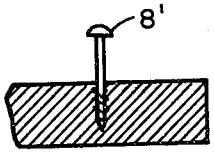
FIG. 5*b* is a partial section on the line 5—5 showing another form of pin.

Preferrably the frame is made of molded plastic, with pins 8 of the type shown in FIG. 5*a*. However, it may be made of wood and the pins may be of the barbed escutcheon pin type shown in FIG. 5*b*. This type pin may also be cast in the molded plastic.

Variable spacing means are provided for holding the members 2, 4, apart. The lengths of the stitches are governed by the distance between the two parallel rows of pins 8. In order to permit the standardization of patterns for various articles the spacing means is made such that the members 2, 4, are held apart by any one of several fixed but selectable distances. The preferred form, particularly when the frame is made of molded plastic, is that shown in FIGS. 3*a* and 3*b*. In member 2 there is a seat 10 having an arcuate base and in member 4 there is a cavity 12 in which is a fixed detent 14. A stitch selector 16 has an arcuate base 18 which fits and is journaled in seat 10. The other end of stitch selector 16 has a series of notches 20 whose bottoms lie on a cam surface that is eccentric to the center of arcuate portion 18. To facilitate adjustment, each stitch selector 16 is preferrably provided on each face with a small protruberance or "pimple" 19. The line from detent 14 to the center of arcuate portion 18 is at right angles to the longitudinal direction of members 2 and 4. The notches 20 are so positioned that the length of this line, and therefore the distance between the rows of pins 8 will change by a fixed amount as detent 14 engages successive notches 20. The notches are numbered, as shown in FIG. 3*b*, and the number of the notch engaging the detent 14 is visible through opening 22 as shown in FIG. 3*a*. A stitch selector is provided near each end of members 2 and 4.

The members 2, 4, are clamped together by bolts 24. Preferrably threaded metal inserts 26 are provided in member 4 to engage the bolts. Other types of clamping means might be used.

To change the stitch length, bolts 24 are loosened, stitch selectors 16 are moved to the desired setting, and bolts 24 are tightened.

Since the stitch selectors 16 sit in seats 10, they are readily replaced and different selectors may be substituted having different ranges of adjustment and/or different differences between successive notches.

As has been previously mentioned, the line between each detent 14 and the center of the arcuate base 18 of the corresponding stitch selector 16 is at right angles to the longitudinal axes of members 2 and 4. The stitch selectors therefore act as fulcrums and the tightening of bolts 24 exerts moments which tend to resist the bending moments exerted by the yarn wrapped on pins 8.

Tabs 30 cooperate with members 2 and 4 to form slots for holding yarn in place. Alternatively, slots may be provided in the ends of members 2 and 4 themselves.

Figure 4:
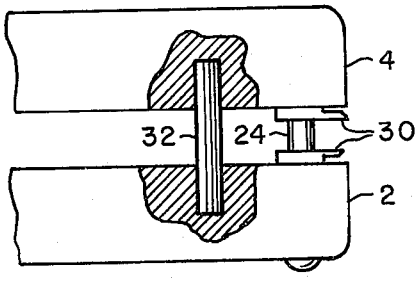
FIG. 4 is a partial plan view broken away to show interior structure, showing another form of variable spacing means.

FIG. 4 shows an alternative form of spacing means for members 2 and 4. It is less convenient to use than stitch selectors 16, but is simpler to manufacture. Replaceable dowel pins 32 at right angles to bars 2 and 4 fit loosely in sockets in, and near each end of, members 2 and 4. To change the spacing, and therefore the stitch length, bolts 24 are removed and dowel pins 32 are replaced by others of different length. The pins preferrably carry numbers to indicate the stitch lengths which they produce. The dowels act as fulcrums in the same manner as the stitch selectors.

Figure 6A:
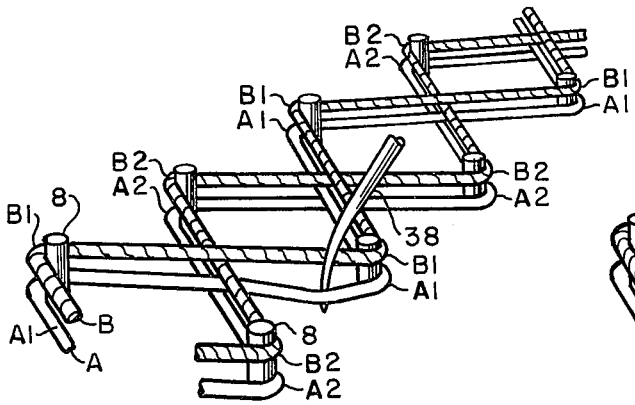
FIGS. 6*a* and 6*b* are diagramatic views showing the manner in which the stitches are formed.
Figure 6B:
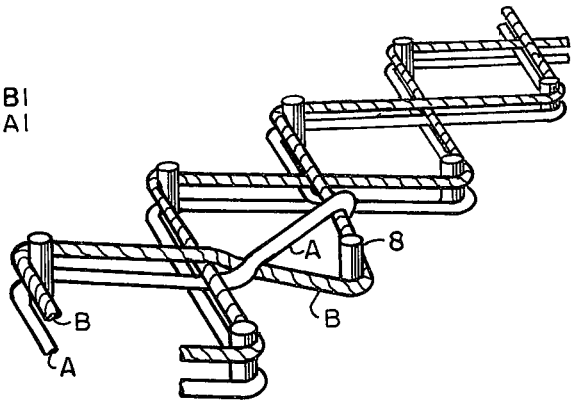

The manner of forming the stitches is shown diagramatically in FIGS. 6*a* and 6*b*. Two layers of yarn, A, B, are looped back and forth around the pins 8, as will be described later in more detail. Using the tool 38, inserted as shown in FIG. 6*a*, the lower layer A is lifted over each pin, as shown for one pin in FIG. 6*b*. When this has been carried out on each pin, forming a row of knitted stitches, the yarn is pressed down to the bottom of pins 8, using the back of tool 38. A third layer is then laid down and the second layer B lifted over each post. This series of steps is repeated many times and results in a strip of knitted fabric emerging through the slot 6 between members 2 and 4.

While the yarn is being lifted over the pins 8, it is held in place by insertion of the unused portion in the slots formed by tabs 30 or those alternatively formed in members 2 and 4.

Figure 7:
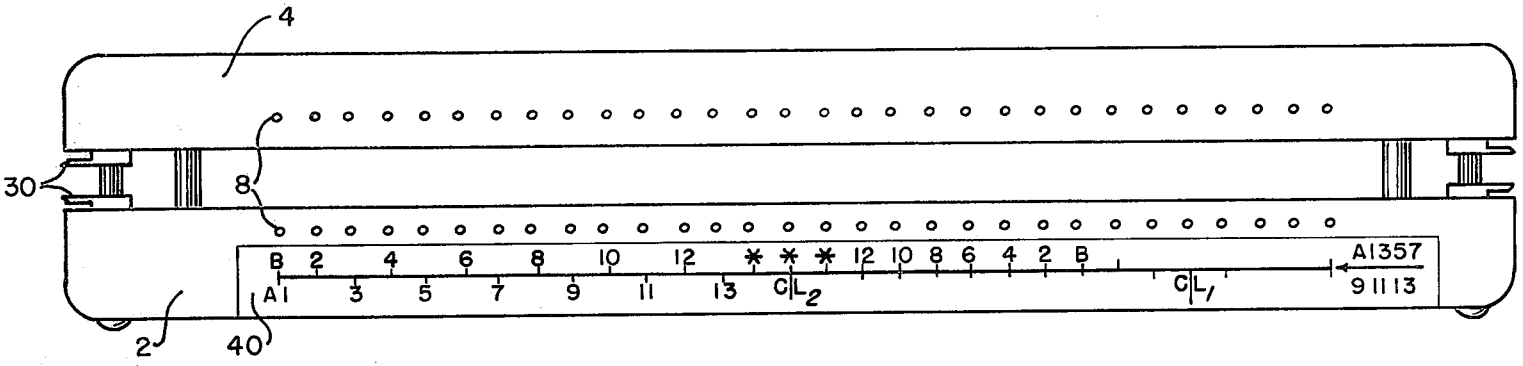
FIG. 7 is a plan view of a frame provided with an illustrative pattern strip.

Referring now to FIGS. 1 and 7, the frame is provided with at least one removable pattern strip 40 which carries indicia in the form of letters and/or numerals and other symbols which are so spaced as to match the spacing of the pins. While strip 40 is shown only on frame member 2, it is desirable to provide a duplicate strip on member 4 also. These pattern strips are specific to certain articles to be knitted. They may be, for example, formed of pressure-sensitive gummed tape, or may be of plastic and provided with clips for removably securing them to members 2 and 4. Thus, members 2 and 4 may have annular grooves 41 in their upper surfaces and strips 40 may be provided with corresponding molded projections on their lower surfaces which will fit in these grooves. The indicia are associated with a system of knitting which I have developed, which I term "centerline knitting". The basic principle of this system resides in the fact that for a given row of stitches, the yarn is applied to the frame beginning and ending at a particular point on the frame, which may remain the same for the entire article, and thus forms a "centerline". In different rows of stitches the yarn is wrapped on the pins different distances in each direction from this "centerline" in accordance with a pre-designed pattern strip and supplementary instructions.

Where there are more than one color of yarn, there may be more than one "centerline" as illustrated by $CL_1$ and $CL_2$ on FIG. 7.

In forming a given row of stitches the first layer A of yarn is looped back and forth, beginning at the centerline, using alternate pins 8 on each member 2, 4, as shown at $A_1$ in FIG. 6*a*. When an extremity of the row is reached the yarn is looped over the other pins 8, as shown at $A_2$, back past the "centerline" to the other extremity. There will now be vacant pins between this second extremity and the "centerline". The yarn is now looped back and forth over these vacant pins until the "centerline" is reached. A second layer B is then applied and the stitches are formed as described above.

Figure 8:
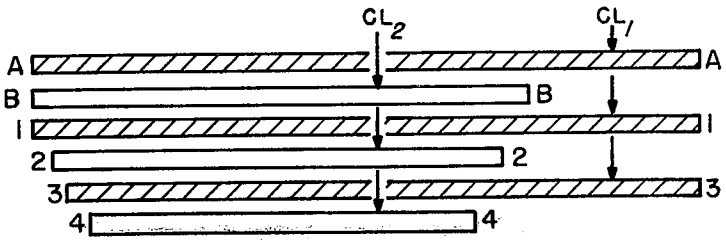
FIG. 8 shows a portion of an illustrative chart used in conjunction with the pattern strip of FIG. 7.

The use of the pattern tapes is illustrated by FIG. 7, which shows an example of such a strip in place on a frame, and FIG. 8, which shows portion of a chart which is furnished to the user along with appropriate instructions as to its interpretation.

As will be seen from FIG. 7, the pattern strip is so positioned that each symbol is adjacent to a pin. The particular pattern calls for two yarns of different color, A and B. In FIG. 8, the bars show the extent of rows of stitches. The cross-hatched bars are used with yarn A and the open bars with color B. The "introductory rows" are termed "A" and "B", corresponding to the color of yarn used in them. The remaining rows are numbered. It will also be noted that there are two centerline markings, $CL_1$for color A and $CL_2$ for color B. The symbols at the end of each bar indicate the numbers on the strip 40 which constitute the terminals of that row of stitches.

The significance is as follows. Begin with yarn A at $CL_1$, loop it back and forth to the left on alternate pins, as course $A_1$, FIG. 6*a*, to pin A, at the left of FIG. 7. Then proceed to the right, course $A_2$, FIG. 6*a*. Continue to the right to the right-hand pin A, then back to the left to $CL_1$, secure yarn A by tabs 30.

Now take yarn B, beginning at $CL_2$, loop it across alternate pins to the left as course $B_1$, FIG. 6*a* , until pin B (which happens to be the same as pin A) is reached, to the right to the other pin B, and back to $CL_2$. Secure yarn B by tabs 30. Lift yarn A over yarn B at each post 8, FIG. 6*b* , forming a first row of stitches.

Again take yarn A, begin at $CL_1$, loop it to the left in the same manner as before to pin 1 (which happens to be the same as pin A), to the right to the second pin 1 (which happens to be the same as the second pin A), and back to $Cl_1$. Secure yarn A by tab 30. At each post 8 lift yarn B over this newly applied layer of yarn A, forming a second row of stitches.

Take yarn B, begin at $CL_2$, loop it around the pins to the left to pin 2, back to the right to the second pin 2, finally to the left to $CL_2$. Secure yarn B with tab 30. Lift yarn A (the layer described in the last paragraph) over yarn B at each post, forming a third row of stitches.

The user would continue as indicated by the chart and directions which might, for instance, say "repeat rows 1 to 13 five times". There may also be instructions or indications for special treatment at certain points, as, for example, accumulating three layers of yarn at pins marked with stars (*) (see FIG. 7) and lifting the lower layer over the other two.

I claim as my invention:

1. A manual knitting frame comprising two parallel elongated frame members, connecting means joining said frame members in such a manner as to leave an elongated slot between them, said members having upper surfaces defining a plane, a row of spaced pins on each frame member, said pins being of substantially uniform height and substantially perpendicular to said plane and said rows being parallel to said slot, the height of said pins being of the same order of magnitude as the spaces between them in the rows, said connecting means comprising variable spacing means holding said elongated members apart by any one of several fixed but selectable distances, such that the rows are spaced apart by a distance in the approximate range of twice the height of said pins to six times said height, said connecting means comprising clamping means urging said elongated members toward each other and at least one movable stitch selector holding said members apart, said stitch selector being journaled for partial rotation about an axis in one of said elongated members and having a curved edge spaced from said axis of rotation, said curved edge being provided with a series of notches, the bottoms of said notches lying on a curve eccentric to said axis of rotation, and a fixed detent on the other of said elongated members positioned to engage in any one of said notches.

2. A manual knitting frame as defined in claim 1 wherein said clamping means comprises a clamping member adjacent each end of said elongated members and said abutment means comprises two of said stitch selectors, each positioned near, but inwardly of, said clamping means, whereby said stitch selectors act as fulcrums for said clamping means to resist bending of the central portions of said elongated members toward each other.

3. A manual knitting frame as defined in claim 1 and including at least one readily replaceable pattern strip extending along the row of pins on at least one of said elongated members, said pattern strip bearing (a) a centerline marking indicating the starting and ending point for applying yarn to said pins for a given series of stitches, and (b) other indicia indicating the extremities of specified rows of stitches.

* * * * *